US009752337B1

(12) United States Patent
Stewart et al.

(10) Patent No.: US 9,752,337 B1
(45) Date of Patent: Sep. 5, 2017

(54) MULTISTORY RESIDENTIAL BUILDING WITH ELEVATOR SERVED UPPER CORRIDOR

(71) Applicant: S&T Joint Venture, Dallas, TX (US)

(72) Inventors: Jerry W. Stewart, Dallas, TX (US); W. Bryan Thruston, Dallas, TX (US)

(73) Assignee: S&T Joint Venture, Dallas, TX (US)

( * ) Notice: Subject to any disclaimer, the term of this patent is extended or adjusted under 35 U.S.C. 154(b) by 65 days.

(21) Appl. No.: 14/863,076

(22) Filed: Sep. 23, 2015

(51) Int. Cl.

| | |
|---|---|
| ***E04H 1/04*** | (2006.01) |
| ***E04H 6/00*** | (2006.01) |
| ***E04F 11/02*** | (2006.01) |
| ***E04F 19/00*** | (2006.01) |
| ***B66B 9/00*** | (2006.01) |

(52) U.S. Cl.
CPC ..... *E04H 1/04* (2013.01); *B66B 9/00* (2013.01); *E04F 11/02* (2013.01); *E04F 19/00* (2013.01); *E04H 6/00* (2013.01)

(58) Field of Classification Search
CPC ..... E04H 1/02; E04H 1/04; E04H 6/02; E04F 11/02
See application file for complete search history.

(56) References Cited

U.S. PATENT DOCUMENTS 3,192,633 A * 7/1965 Pratt ..... G01C 15/04 116/209
3,656,266 A * 4/1972 Tylius ..... E04B 1/04 52/185
3,750,354 A * 8/1973 Boros ..... E04H 1/04 52/220.2
4,596,097 A 6/1986 Stewart et al.
4,794,747 A * 1/1989 Yendo ..... E04H 1/04 52/236.3
5,694,725 A * 12/1997 Kaufman ..... E04H 1/04 52/234

(Continued)

OTHER PUBLICATIONS

Fair Housing Act Design Manual, U.S. Dept. of Housing and Urban Development, Office of Fair Housing and Equal Opportunity, and Office of Housing, Apr. 1998, 334 pgs.

*Primary Examiner* — Robert Canfield
(74) *Attorney, Agent, or Firm* — Gardere Wynne Sewell LLP

(57) ABSTRACT

A mid-rise residential building with a garage section, a lower section disposed above the garage section, and an upper section disposed above the lower section is disclosed. The upper section includes a corridor that traverses the building, but the lower section does not include such a corridor. The garage section includes a plurality of private garages. The lower section includes at least a pair of multistory dwelling units, where each unit has a through unit floor plan and each unit provides direct access to a respective private garage. The upper section includes a corridor. The upper section also includes a single story dwelling unit that is primarily accessible from the corridor; and at least two multistory dwelling units that have respective entranceways disposed laterally across the corridor from the single story dwelling unit. Each of the multistory dwelling units has a second floor with portions directly above the corridor and the single story dwelling unit. An elevator serves the corridor of the upper section, but it bypasses the lower section.

22 Claims, 17 Drawing Sheets

(56) References Cited

U.S. PATENT DOCUMENTS 5,809,704 A * 9/1998 Stewart ..... E04H 1/04 52/169.4
6,155,012 A * 12/2000 Halbitte ..... E04H 1/04 52/169.4
6,405,496 B1 * 6/2002 Stewart ..... E04H 1/04 52/169.3
7,036,281 B2 * 5/2006 Stewart ..... E04H 6/10 52/169.4
7,497,055 B2 * 3/2009 Stewart ..... E04H 6/10 52/169.4
7,676,998 B2 * 3/2010 Lessard ..... E04H 1/005 52/185
7,779,586 B2 * 8/2010 Stewart ..... E04H 1/04 52/175
8,033,067 B2 * 10/2011 Miller ..... E04F 11/02 52/236.3
8,474,203 B1 7/2013 Stewart et al.
2002/0073637 A1 * 6/2002 Stewart ..... E04H 1/04 52/236.3
2003/0005653 A1 * 1/2003 Sataka ..... E04H 1/04 52/236.3
2003/0172604 A1 * 9/2003 Rood ..... E04H 1/04 52/236.3
2004/0006940 A1 * 1/2004 Gray ..... E04H 1/04 52/236.3
2004/0206018 A1 * 10/2004 Stewart ..... E04H 1/04 52/79.1
2005/0115166 A1 * 6/2005 Miller ..... E04H 1/04 52/79.1
2006/0156658 A1 * 7/2006 Stewart ..... E04H 6/10 52/236.3
2009/0113821 A1 * 5/2009 Guo ..... E04H 1/04 52/173.1
2009/0293384 A1 * 12/2009 Miller ..... E04F 11/02 52/185
2016/0348385 A1 * 12/2016 Bottarelli ..... E04H 1/04

* cited by examiner

MULTISTORY RESIDENTIAL BUILDING WITH ELEVATOR SERVED UPPER CORRIDOR

TECHNICAL FIELD

The present disclosure relates generally to residential buildings and more particularly to residential buildings with multi-story dwelling units employing a combination of townhouse-type dwelling units and above-grade dwelling units that are served by an elevator.

BACKGROUND

Midrise residential buildings typically have 4-7 floors or stories. Each story is typically served by an elevator because it is generally understood in the residential architecture industry that residents in buildings over four stories are apt to rent on the fourth or higher story only if there is elevator access, so that they do not have to walk up four or more flights of stairs to access their dwelling unit.

Numerous requirements and guidelines at local, state, and federal levels govern new residential construction. For example, the Fair Housing Act of 1988 amended The Civil Rights Act of 1968 and includes requirements pertaining to housing that is accessible for the disabled. The Fair Housing Accessibility Guidelines (the "Guidelines") were published on Mar. 6, 1991 and provide technical guidance on designing dwelling units as required by the Fair Housing Act. The United States Department of Housing and Urban Development published the Fair Housing Act Design Manual in 1996 and updated it in 1998. The Design Manual provides comprehensive information regarding accessibility requirements to be incorporated in the design and construction of multi-family housing covered by the Fair Housing Act. Residential buildings that are constructed consistent with the Design Manual will comply with the Guidelines, and therefore will also comply with the accessibility of the Fair Housing Act.

The Guidelines require that in buildings with four or more dwelling units, all ground floor units in residential buildings without elevators and all dwelling units in buildings served by one or more elevators be covered by the accessibility requirements of the Fair Housing Act. However, if an elevator is provided solely to provide an accessible route to a ground floor level above grade, the building is not considered "a building with one or more elevators." The Design Manual provides examples of this exception in connection with elevator served dwelling units above grade that are often located above grade level parking or grade level retail uses. Also, elevator served dwelling units above grade may be employed with buildings on severely sloping sites.

A need exists for residential buildings with a combination of multi-level dwelling units and dwelling units on a single level that are accessible to the disabled. Buildings with this combination of dwelling units should maximize the density of rentable space and comply with the Guidelines.

SUMMARY

A mid-rise residential building with a garage section, a lower section disposed above the garage section, and an upper section disposed above the lower section is disclosed. The upper section includes a corridor that traverses the building, but the lower section does not include such a corridor. The garage section includes a plurality of private garages. The lower section includes at least a pair of multistory dwelling units, where each unit has a through unit floor plan and each unit provides direct access to a respective private garage. The upper section includes a corridor. The upper section also includes a single story dwelling unit that is primarily accessible from the corridor; and at least two multistory dwelling units that have respective entranceways disposed laterally across the corridor from the single story dwelling unit. Each of the multistory dwelling units has a second floor with portions directly above the corridor and the single story dwelling unit. An elevator serves the corridor of the upper section, but it bypasses the lower section.

According to some embodiments, the lower section of the mid-rise residential building is not covered by design and construction requirements of the Fair Housing Act, but the upper section is covered by design and construction requirements of the Fair Housing Act.

According to other embodiments, the upper section comprises three multistory dwelling units with respective entranceways disposed laterally across the corridor from the single story dwelling unit. Alternatively, the entranceways of the three multistory dwelling units are disposed laterally across the corridor from a fourth multi-story dwelling unit.

The foregoing and other features and advantages of the present disclosure will become further apparent from the following detailed description of the embodiments, read in conjunction with the accompanying drawings. The detailed description and drawings are merely illustrative of the disclosure, rather than limiting the scope of the disclosure as defined by the appended claims and equivalents thereof.

BRIEF DESCRIPTION OF THE DRAWINGS

Embodiments are illustrated by way of example in the accompanying figures, in which like reference numbers indicate similar parts, and in which.

DETAILED DESCRIPTION OF THE DRAWINGS

Figure 1:
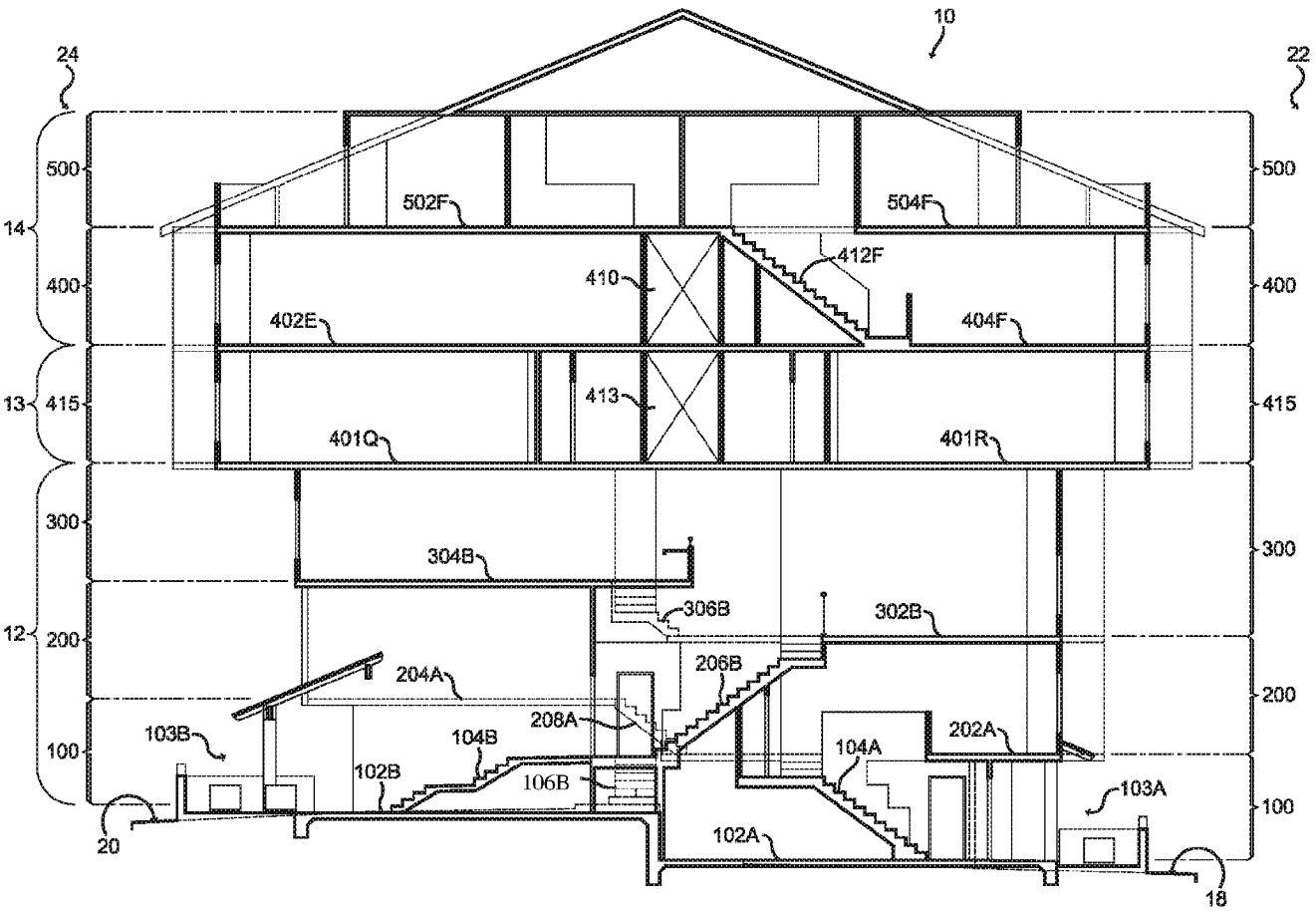
FIG. 1 is a cross-section view of a mid-rise residential building according to the teachings of the present disclosure.

In the description which follows, like features or elements are marked throughout the specification and drawings with the same reference numerals.

The present disclosure provides multilevel apartments with attached private garages in a lower section of a midrise residential building, and also provides an upper section with disabled accessible dwelling units on one or more elevator served floors. The dwelling units of the lower section may be considered "townhouse-type apartments" because they are narrow, multistory apartments with private garages and pedestrian entries only at grade. An elevator of the midrise building bypasses the townhouse-type apartments and provides access to the dwelling units disposed immediately above them.

FIG. 1 illustrates a midrise residential building 10 shown in cross section to illustrate the interrelationship among the floors (also referred to as stories), elevation changes, stairways, and entranceways. The building 10 includes at least five floors of area suitable for either living or a personal garage space. Such space will be referred to as dwelling area. The illustrated embodiment includes six floors of dwelling area. In this description, the collective dwelling areas are parsed into a lower section 12, a midsection 13, and an upper section 14.

The lower section 12 includes a first story 100, a second story 200 disposed directly above the first story 100, and a third story 300 disposed directly above the second story 200. The lower section 12 includes two multistory dwelling units A and B, and each multistory dwelling unit A, B includes direct access to a respective private garage. Uppercase letters are used herein to designate particular dwelling units, and each dwelling unit is associated with the reference numbers that have a corresponding suffix letter. For example, dwelling unit "A" is associated with elements 102A, 103A, 104A, etc. Similarly, dwelling unit "B" is associated with elements 102B, 103B, 104B, etc. Private access means that an individual may access the garage associated with that individual's dwelling unit from that individual's dwelling unit without having to traverse a public or common area.

Figure 2:
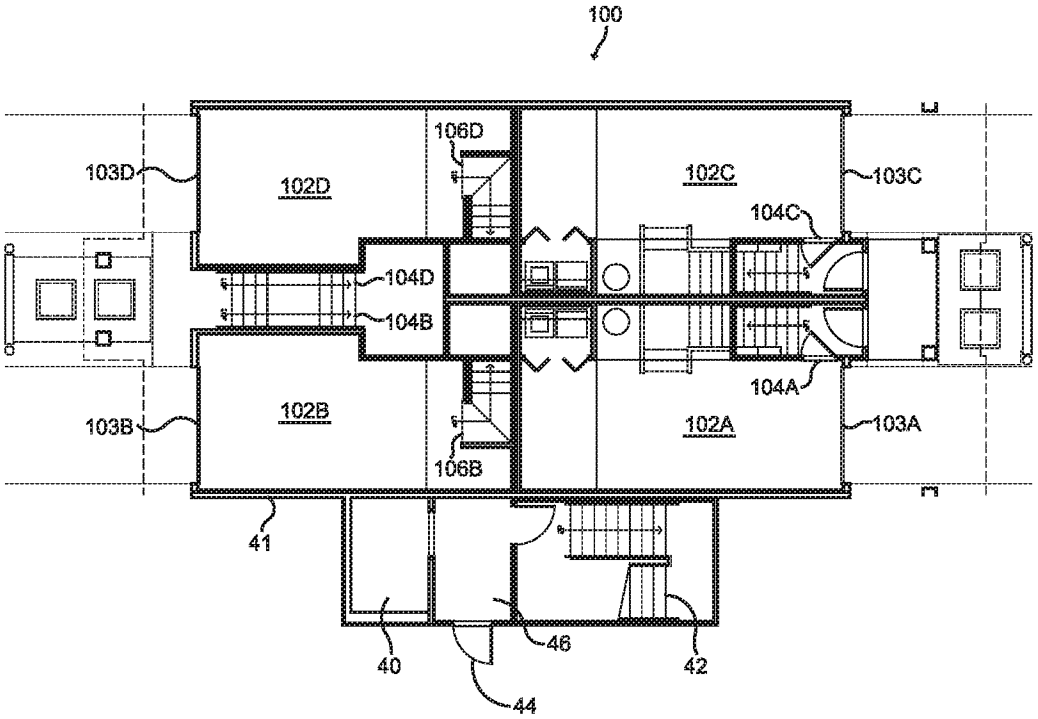
FIG. 2 is a plan view drawing of the first story of the mid-rise residential building illustrated in FIG. 1.

The lower section 12 of building 10 also includes at least two other dwelling units C and D that are numbered similarly to dwelling units A and B (see FIG. 2). Dwelling unit C includes the same elements and is disposed the same as shown and described below with respect to dwelling unit A; dwelling unit D includes the same elements and is disposed the same as shown and described below with respect to dwelling unit B. In order to simplify this disclosure, dwelling units C and D are not described separately from dwelling units A and B. The lower section 12 employs the teachings of U.S. Pat. No. 4,596,097, to Stewart et al. and issued Jun. 24, 1986, and entitled "Multiple-Dwelling Structure," the disclosure of which is hereby incorporated by reference.

Referring to FIG. 1 together with FIG. 2, which is a floor plan of the first story 100. The first story 100 is private garage space. A first garage 102A has a vehicular entrance 103A on a first side of the building 10. A second garage 102B has a vehicular entrance 103B on an opposite site of the building. As such, the garages are in back-to-back relationship to each other. The vehicular entrance 103A for the first garage space 102A is at a first ground or grade level 18. The vehicular entrance 103B on the opposite side is at a second ground or grade level 20. The second ground level 20 is one-half story higher in elevation than the first ground level 18.

The garages 102A and 102B naturally include space sufficient to park at least one car. The garages 102A and 102B may also include utilities such as a hot water heater, a washer and dryer, a utility sink, an air conditioner and the like.

A stairway 104A provides a passageway between the garage 102A and a lower living space 202A (see FIG. 1). As such, the "A" dwelling unit has direct access to garage space 102A. A stairway 106B leads from garage space 102B to a private stairway 206B (see FIG. 1). Together the private stairway 206B and the stairway 106B provide a direct access garage 102B for the "B" dwelling unit.

An outside stairway 104B leads from second ground level 20 to the private stairway 206B so as to provide access for the B dwelling unit to the second grade level 20 without having to access the garage. In an alternate embodiment, the stairway 104B may be partially or fully enclosed.

FIG. 2 also illustrates an elevator 40 and a fire stairway 42. An elevator shaft associated with the elevator 40 is disposed outside an exterior wall 41 of the building 10 and is at least partly supported by the exterior wall 41. The fire stairway 42 is also partly supported by the exterior wall 41. A resident of mid-section 13 or upper section 14 accesses his residence using the elevator 40. From outside the building 10, the resident enters through a vestibule entrance 44 into a vestibule 46. The elevator 40 bypasses the second story 200 and the third story 300, but provides access to the corridors of the fourth story 415 and the fifth story 400, as described further below. The fire stairway 42 also facilitates access to the residences of the fourth story 415 and the fifth story 400 and may be used in situations, such as an emergency, when the elevator 40 is not operating.

Figure 3:
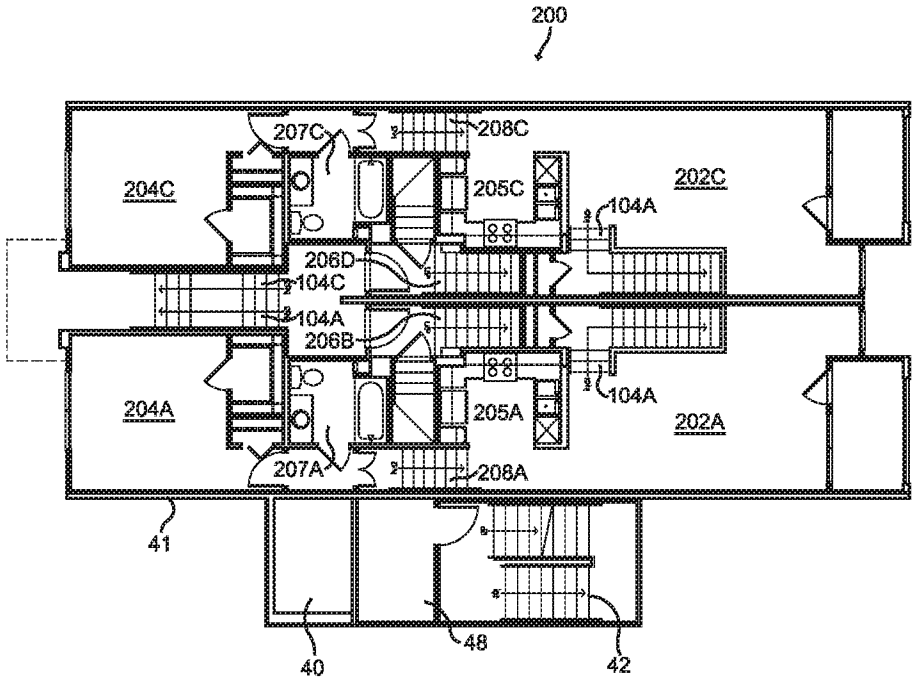
FIG. 3 is a plan view drawing of the second story of the mid-rise residential building illustrated in FIG. 1.

Referring to FIG. 1 together with FIG. 3, which is a floor plan of the second story 200. As stated above, the elevator 40 bypasses the second story 200, and thus there is no access from the elevator 40 to the dwelling units on the second story 200. According to certain embodiments, a landing 48 of the fire stairway 42 is disposed on the second story 200. However, an alternate embodiment may omit the landing 48.

The second story 200 includes the "A" dwelling unit (and the "C" dwelling unit), which is a multi-level dwelling unit with living space 202A disposed one-half story below living space, or more specifically, bedroom 204A. A stairway 208A traverses one-half story and provides access between living spaces 202A and 204A. A kitchen area 205A is disposed on the lower half-level along with living room 202A, and the bedroom 204A and a full bathroom 207A are on the upper half-level of the "A" dwelling unit. FIG. 3 also shows private stairway 206B, which runs through the second story 200 but does not provide access to second story 200 because it is a private stairway 206B providing the B unit direct access to stairway 106B, which in turn provides direct access to the garage space 102B.

The "A" dwelling unit of second story 200 is a through-type unit. A through-type unit has a floor plan that extends from one side of the building to the other side of the building. A through-type unit is often preferable to dwelling-units that have a back-to-back type configuration because the through-type unit ensures that the "A" dwelling unit has a preferable view. Most apartment buildings or condominium buildings are situated to have a preferable view on the view side 22, and a less preferable view on the other side or non-view side 24 (see FIG. 1). For example, a pool or a courtyard may be disposed on the view side 22 of the midrise building 10, and a parking lot or street may be disposed on the non-view side 24 of the midrise building 10. In this example, an apartment or condominium with widows looking outward to the view side 22 may be more valuable in sales price or rent than a unit with only windows looking out to the non-view side 24 of building 10. In building 10, all dwelling units A, B, C, D in the lower section 12 have a window or balcony allowing for a view of preferable view side 22 of building 10.

Figure 4:
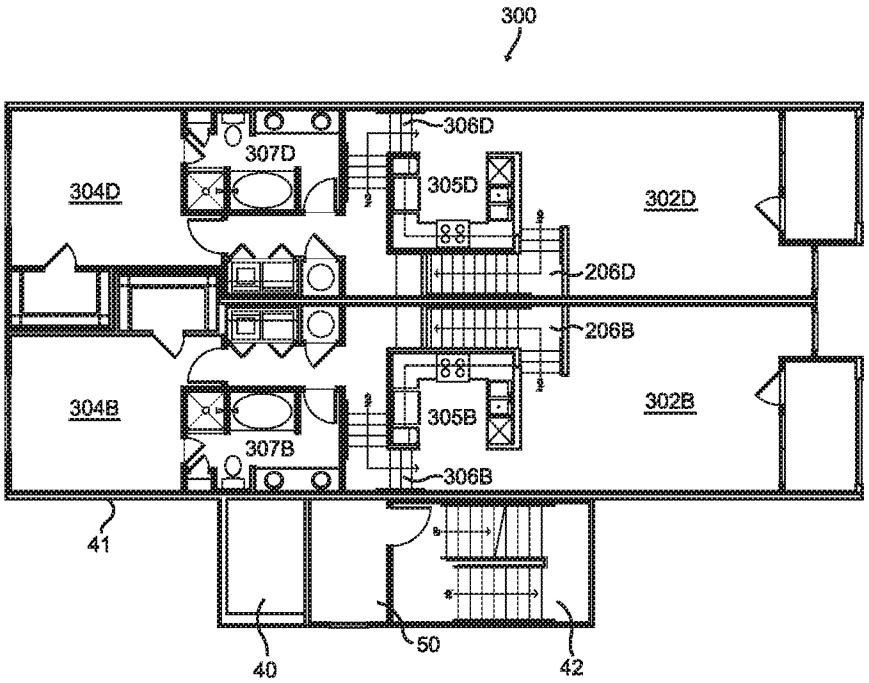
FIG. 4 is a plan view drawing of the third story of the mid-rise residential building illustrated in FIG. 1.

Referring to FIG. 1 together with FIG. 4, which is a floor plan of the third story 300. Naturally, the third story 300 is disposed directly above second story 200. Again, the elevator 40 bypasses the third story 300, and thus there is no access from the elevator 40 to the dwelling area on the third story 300. According to certain embodiments, a landing 50 of the fire stairway 42 is disposed on the third story 300. However, an alternate embodiment may omit the landing 50.

As previously described, the private stairway 206B runs from one-half story above second ground level 20 directly to dwelling unit B. As such, dwelling unit B has direct access to garage 102B. Similar to the second story 200, the third story 300 includes the B dwelling unit (and the D dwelling unit), which includes area 302B that is disposed one-half story below living area, or more specifically, bedroom 304B. A stairway 306B traverses one-half story and provides access between living spaces 302B and 304B. A kitchen area 305B is disposed on the lower half-level along with living area 302B, and a bedroom 304B and a full bathroom 307B are on the upper half-level of the B dwelling unit. Dwelling unit B is defined by a through-unit-type floor plan, and therefore includes a view of view side 22 of midrise building 10.

As shown in FIG. 2, garage 102C is disposed adjacent garage 102A, and garage 102D is disposed adjacent garage 102B. As shown in FIGS. 2-4, a dwelling unit C is disposed on the second story 200 and has direct access to garage 102C. A dwelling unit D is disposed on the third story 300 and has direct access to the garage 102D. Both C and D dwelling units have through-unit type floor plans.

Figure 5:
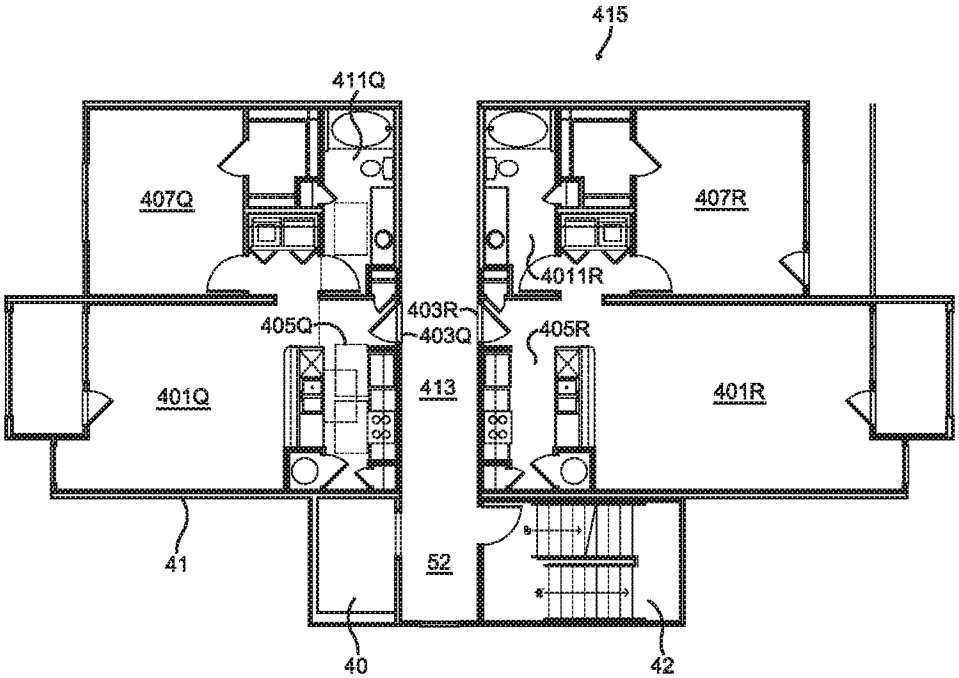
FIG. 5 is a plan view drawing of the fourth story of the mid-rise residential building illustrated in FIG. 1.

FIG. 5 illustrates floor plans of the dwelling units of the mid-section 13. Referring again to FIG. 1, the mid-section 13 is disposed directly above the lower section 12, and includes the fourth story 415. The mid-section 13 is served by the elevator 40 and also the fire stairway 42. A landing 52 connects a corridor 413 to the elevator 40 and the fire stairway 42. In other embodiments, two elevators will serve the fourth stories 415 of a number of joined buildings 10 (see FIG. 17). Two elevators allow residents use of one elevator if the other is not operational because it is being serviced. The elevator(s) bypasses the lower section 12, and the lower section 12 is accessed by the stairways described above. As such, the lower section 12 is not covered by the Guidelines and is not accessible or compliant with the Americans with Disabilities Act. The mid-section 13 and the upper section 14, however, are covered by the Guidelines, as described in more detail below.

Referring to FIG. 5, which shows a floor plan of the fourth story 415. The fourth story 415 includes the corridor 413, and dwelling units Q and R. Dwelling units Q and R are each fully wheelchair accessible, in part, because they are entirely on the fourth story 415 with elevation changes, if any, which do not require stairs.

Dwelling units Q and R may have the same floor plan, so this disclosure will only provide detail for dwelling unit Q with the understanding that the reference numbers for dwelling unit R are the same as those described for dwelling unit Q. Living area 401Q is accessed through doorway 403Q that allows access from the corridor 413. A kitchen 405Q is disposed adjacent living area 401Q. A bedroom 407Q is disposed adjacent and separated by a doorway from living area 401Q. The bedroom 407Q is served by a bathroom 411Q and closet space. The doorways of dwelling unit Q are large enough to accommodate a wheelchair, according to the Guidelines. Dwelling unit Q is not a through unit-type floor plan in that it does not extend from view-side 22 and to non-view side 24.

Figure 6:
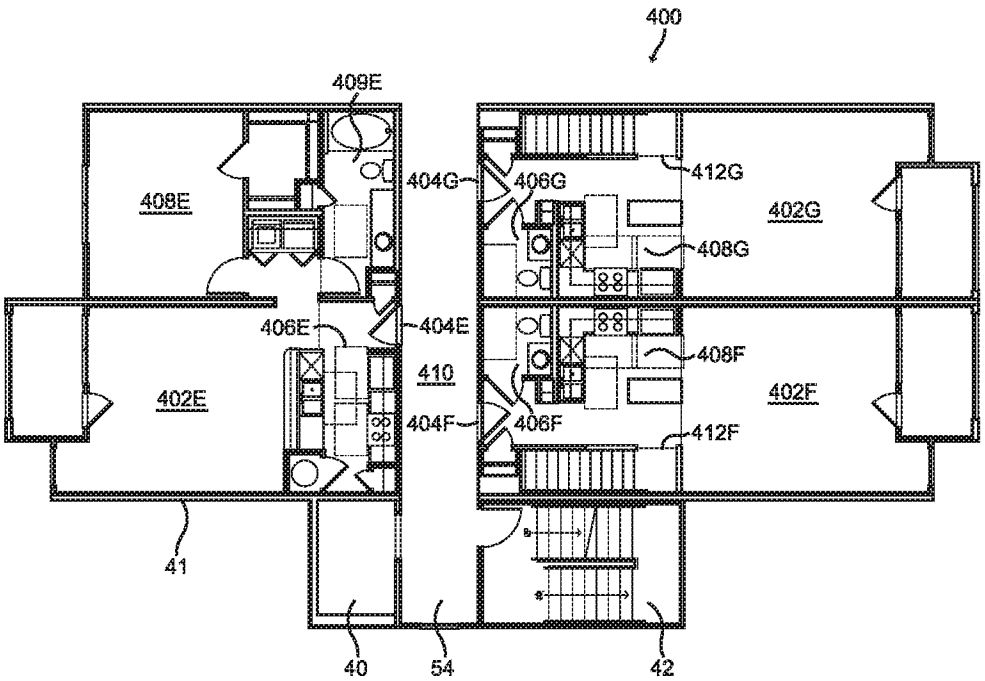
FIG. 6 is a plan view drawing of the fifth story of the mid-rise residential building illustrated in FIG. 1.
Figure 7:
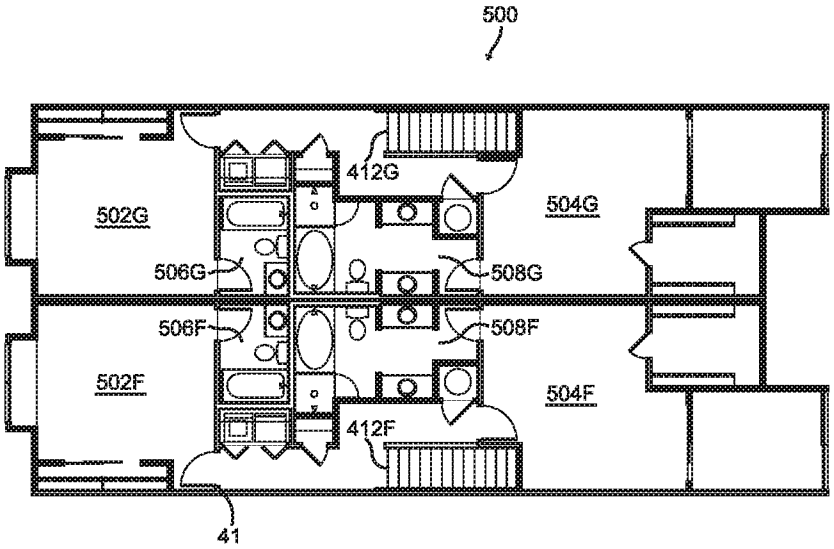
FIG. 7 is a plan view drawing of the sixth story of the mid-rise residential building illustrated in FIG. 1.

FIGS. 6 and 7 illustrate floor plans of the dwelling units of the upper section 14. Referring again to FIG. 1, the upper section 14 is disposed directly above the mid-section 13. The upper section includes fifth story 400 and sixth story 500. The upper section 14 is served by the elevator 40. As such, a landing 54 connects a corridor 410 with the elevator 40 and the fire stairway 42. According to an alternate embodiment, the building 10 may not include a mid-section, and the upper section 14 is disposed directly above the lower section 12 and is served by the elevator 40, which bypasses the lower section 12.

FIG. 6 shows a floor plan of the fifth story 400, which includes the corridor 410, and dwelling units E, and the first floor of multi-level dwelling units F and G. Dwelling unit E is fully wheelchair accessible, in part, because it is entirely on the fourth story 400 with elevation changes, if any, which do not require stairs. Living area 402E is accessed through doorway 404E that allows access from the corridor 410. A kitchen 406E is disposed adjacent living area 402E. A bedroom 408E is disposed adjacent and separated by a doorway from living area 402E. The bedroom 408E is served by a bathroom 409E and closet space. The doorways of dwelling unit E are large enough to accommodate a wheelchair, according to the Guidelines. Dwelling unit E is not a through unit-type floor plan in that it does not extend from view-side 22 and to non-view side 24. Dwelling units F and G are defined by a through unit floor plan at their respective upper levels and therefore include a window or balcony facing the view-side 22.

According to an alternate embodiment, dwelling unit E may be a two-story dwelling unit. In this embodiment, at least a portion of the second stories of each of dwelling units E, F, and G is disposed above the first story of the respective dwelling unit. The second stories of each of dwelling units E, F, and G are accessed by a private stairway within the respective unit.

Dwelling unit F is disposed across the corridor 410 from dwelling unit E and is accessed from the corridor 410 through doorway 404F. Proximate doorway 404F is disposed a powder room 406F. The powder room 406F includes a toilet and a sink. It does not necessarily include a shower. The doorway to the powder room 406F may be wide enough to accommodate a wheelchair, according to the Guidelines. Having a powder room accessible from the first level of dwelling unit F may be a requirement for dwelling unit F to be covered by the Guidelines. Living area 402F is disposed proximate a kitchen 408F. A stairway 412F runs a full story to a second level of dwelling unit F. In the illustrated embodiment, stairway 412F runs from fifth story 400 to sixth story 500.

Disposed directly above fifth story 400 is sixth story 500. In one embodiment, neither the elevator 40 nor the fire stairway 42 ascends to the sixth story 500. With reference to FIG. 7, sixth story 500 includes the second levels of dwelling units F and G. For example, bedrooms 502F and 504F are located on sixth story 500 and are accessible via the stairway 412F. Bedrooms 502F and 504F may only be accessed by the stairway 412F. There is no corridor on the sixth story 500, and there is no public entrance on the sixth story 500. It should be noted that the bedrooms 502F and 504F on the second level of the F dwelling unit traverse above the corridor 410 and together bedrooms 502F and 504F define a through-unit type floor plan. A bathroom 506F is disposed adjacent bedroom 502F, and a bathroom 508F is disposed adjacent bedroom 504F. Each of the bathrooms 506F and 508F are full baths that include a shower or a bathtub in addition to a toilet and a vanity sink.

Disposed adjacent to dwelling unit F on both the fifth story 400 and the sixth story 500 is dwelling unit G, which includes the same features as dwelling unit F including a through-unit type floor plan and a stairway 412G providing a passageway from the first level to the second level. Dwelling unit G also includes a preferred view of view side 22 of the midrise residential building 10 to at least on its upper level that has a through-unit-type floor plan.

Figure 8:
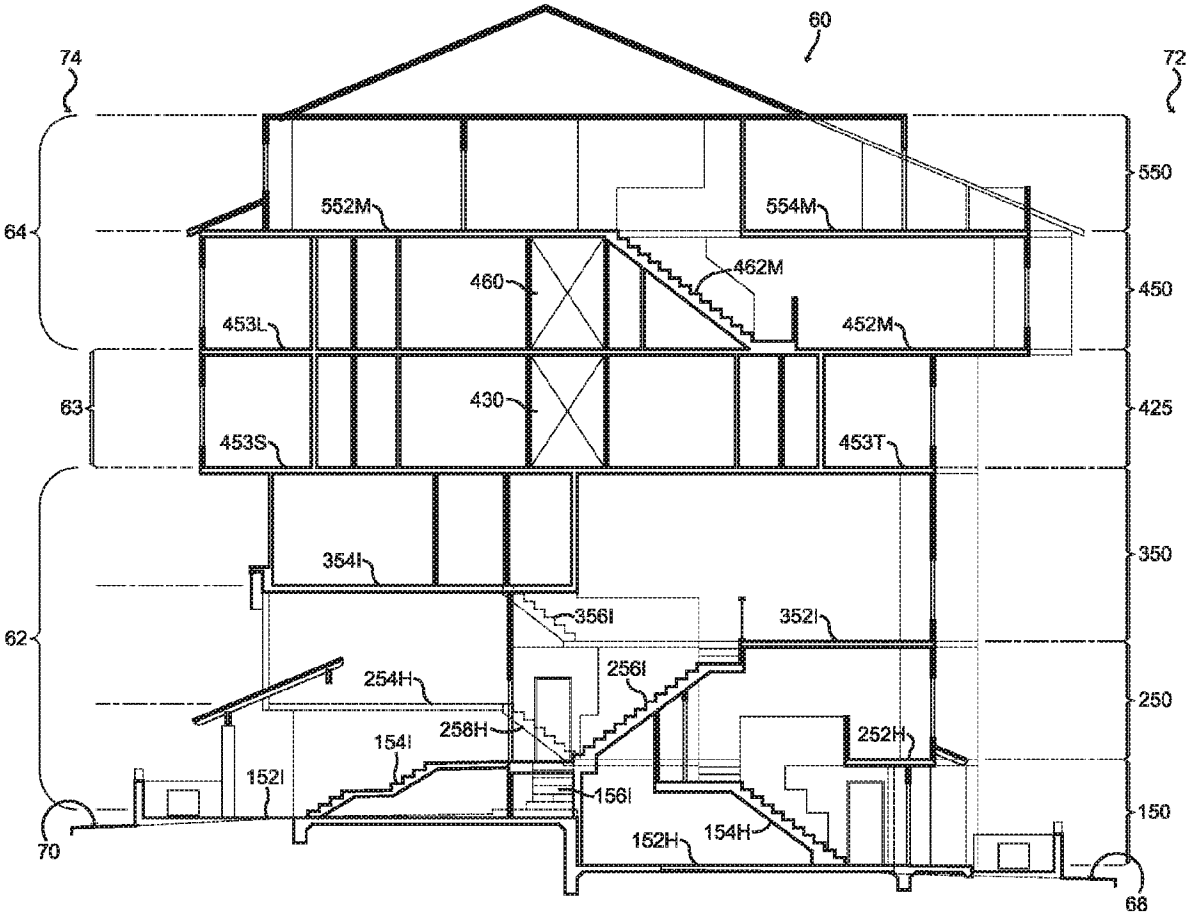
FIG. 8 is a cross-section view of an alternate embodiment of a mid-rise residential building according to the teachings of the present disclosure.

FIG. 8 illustrates an alternate embodiment of a midrise residential building 60 shown in cross section to illustrate the interrelationship among the floors (also referred to as stories), elevation changes, stairways, and entranceways. Similar to building 10, the building 60 includes a lower section 62, a mid-section 63, and an upper section 64. The mid-section 63 and the upper section 64 are served by elevator access, but the lower section 62 is bypassed by the elevator. A footprint of building 60 is larger than a footprint of the building 10.

Figure 9:
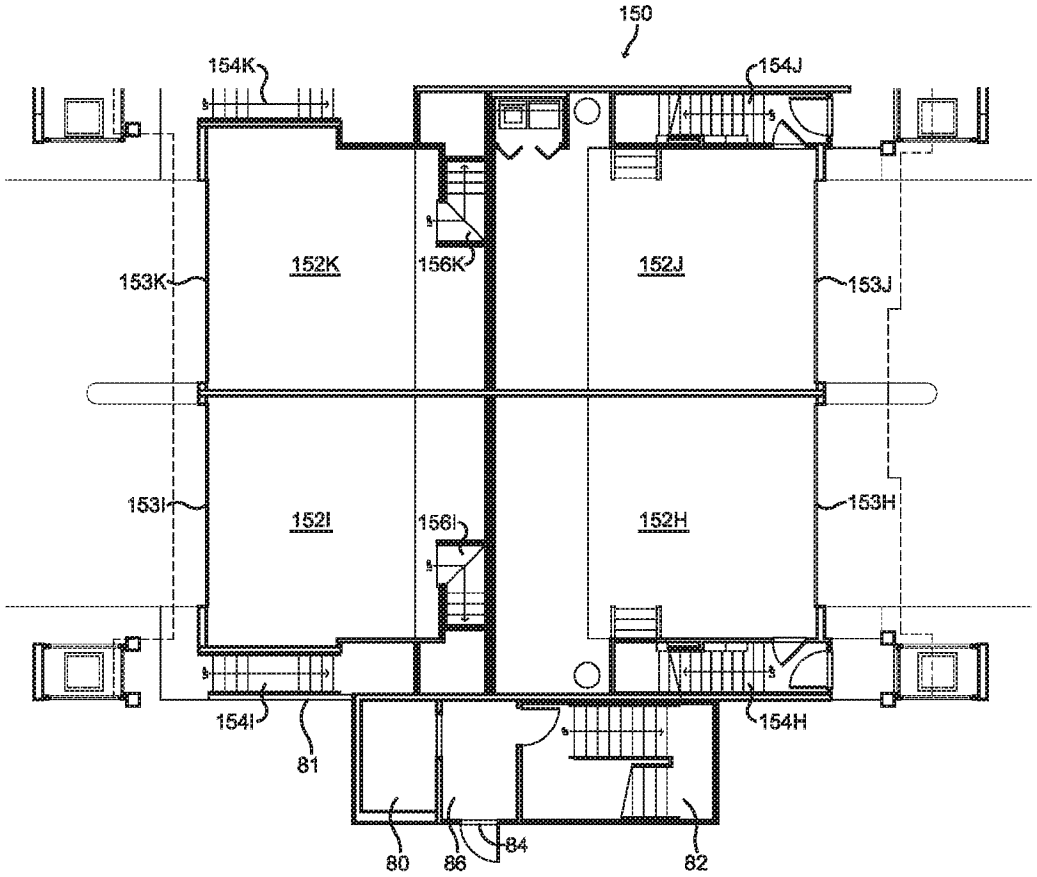
FIG. 9 is a plan view drawing of the first story of the mid-rise residential building illustrated in FIG. 8.
Figure 10:
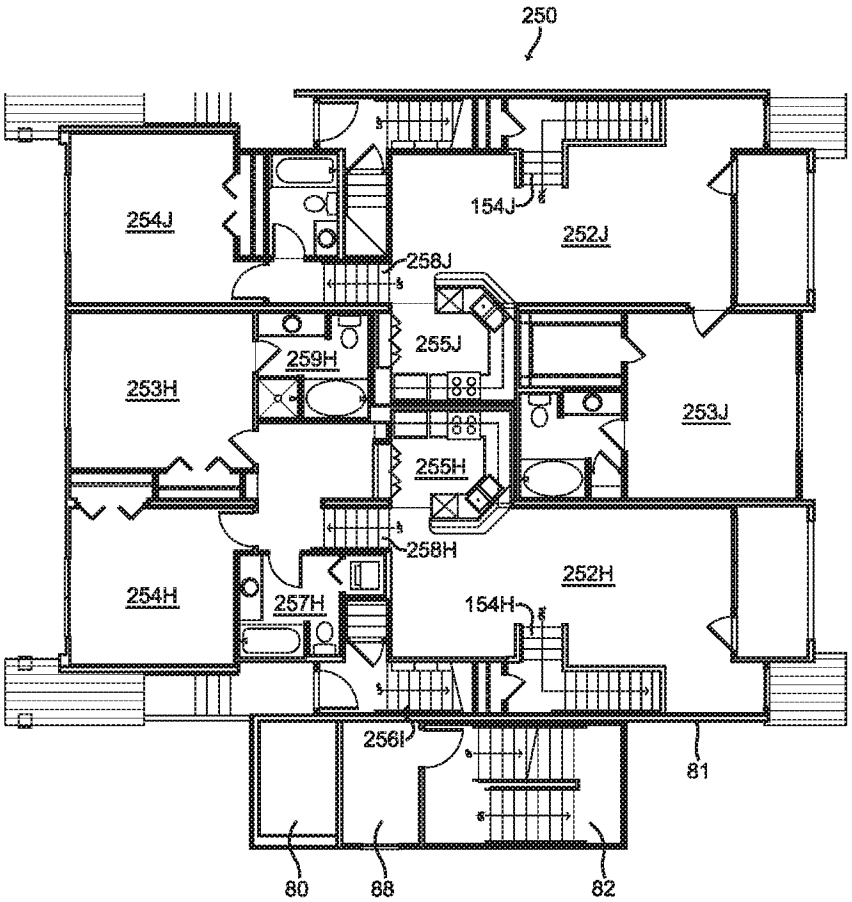
FIG. 10 is a plan view drawing of the second story of the mid-rise residential building illustrated in FIG. 8.
Figure 11:
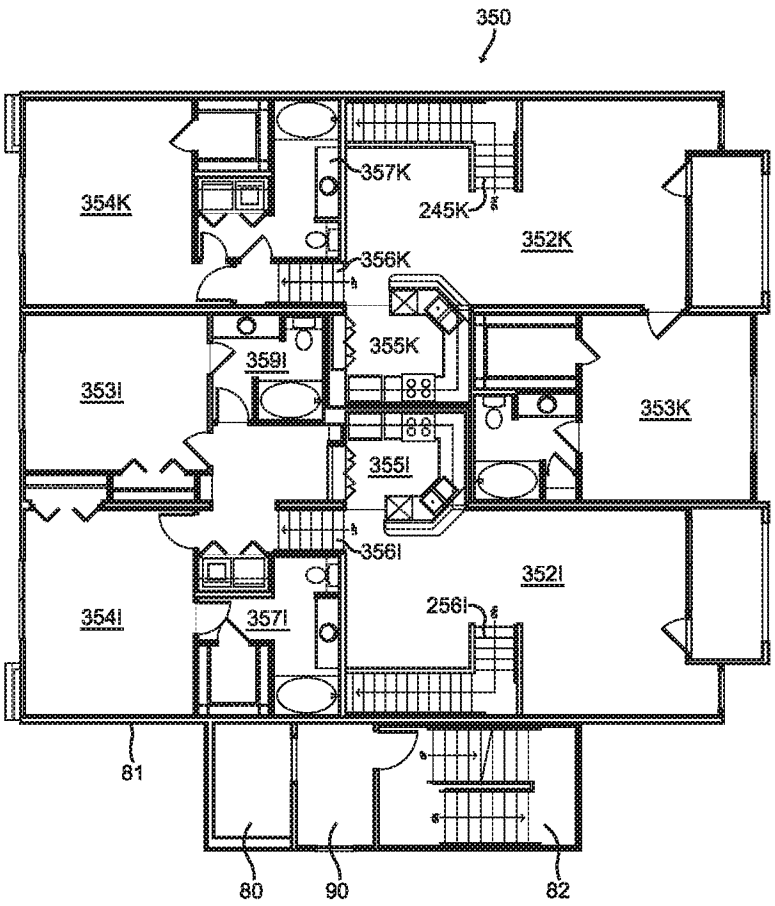
FIG. 11 is a plan view drawing of the third story of the mid-rise residential building illustrated in FIG. 8.

FIGS. 9-11, the floor plans of first story 150, second story 250, and third story 350, illustrate the lower section 62, which includes two multistory dwelling units H and I, and each multistory dwelling unit includes direct access to a respective private garage. The lower section 62 of building 60 also includes at least two other dwelling units J and K that are numbered similarly to dwelling units H and I. Dwelling unit J includes the same elements and is disposed the same as shown and described below with respect to dwelling unit H; dwelling unit K includes the same elements and is disposed the same as shown and described below with respect to dwelling unit I. In order to simplify this disclosure, dwelling units J and K are not described separately from dwelling units H and I. Similar to the embodiment of FIGS. 1-7, the lower section 62 employs the teachings of U.S. Pat. No. 4,596,097, to Stewart et al. and issued Jun. 24, 1986, and entitled Multiple-Dwelling Structure, the disclosure of which is hereby incorporated by reference.

Referring to FIGS. 8 and 9, the first story 150 is a private garage space. A first garage 152H has a vehicular entrance 153H on a first side of the building 60. A second garage 152I has a vehicular entrance 153I on an opposite site of the building. As such, the garages are in back-to-back relationship to each other. The garages 152H and 152I are sized to allow two standard size vehicles to be parked side-by-side. The garages 152H and 152I may also include utilities such as a hot water heater, a washer and dryer, a utility sink, an air conditioner and the like.

Similar to the embodiment shown in FIGS. 1-7, the vehicular entrance 153H for the first garage space 152H is at a first ground or grade level 68, and the vehicular entrance 153I on the opposite side is at a second ground or grade level 70. The second ground level 70 is one-half story higher in elevation than the first ground level 68.

The garages 152H and 152I are each private garages because each is directly coupled to a living space by a private passageway. For example, a stairway 154H provides a passageway between the garage 152H and a lower living space 252H (see FIG. 8). As such, the "H" dwelling unit has direct access to garage space 152H. A stairway 156I leads from garage space 152I to a private stairway 256I (see FIG. 8). Together the private stairway 256I and the stairway 156I provide a direct access garage 152I for the "I" dwelling unit.

An outside stairway 154I leads from second ground level 70 to the private stairway 256I to provide access for the I dwelling unit to the second grade level 70 without having to access the garage. In an alternate embodiment, the stairway 154I may be partially or fully enclosed.

FIG. 9 also illustrates an elevator 80 and a fire stairway 82. An elevator shaft associated with the elevator 80 is disposed outside an exterior wall 81 of the building 60 and is at least partly supported by the exterior wall 81. The fire stairway 82 is also partly supported by the exterior wall 81. A resident of a dwelling unit of the mid-section 63 or the upper section 64 accesses his residence using the elevator 80. From outside the building 60, the resident enters through a vestibule entrance 84 into a vestibule 86. The elevator 80 bypasses the second story 250 and the third story 350, but provides access to the corridors of the fourth story 425 and the fifth story 450, as described further below. The fire stairway 82 also facilitates access to the residences of the fourth story 425 and the fifth story 450 and may be used in situations, such as an emergency, when the elevator 80 is not operating.

Referring to FIG. 8 together with FIG. 10 which is a floor plan of the second story 250. As stated above, the elevator 80 bypasses the second story 250, and thus there is no access from the elevator 80 to the dwelling units on the second story 250. According to certain embodiments, a landing 88 of the fire stairway 82 is disposed on the second story 250. However, an alternate embodiment may omit the landing 88.

The second story 250 includes the "H" dwelling unit (and the "J" dwelling unit), which is a multi-level dwelling unit with living space 252H disposed one-half story below a bedroom living space. Specifically, bedrooms 253H and 254H are disposed one-half story above living space 252H. A stairway 258H traverses one-half story and provides access between living space 252H and bedroom living spaces 253H and 254H. A kitchen area 255H is disposed on the lower half-level along with living room 252H. Each of the bedrooms 253H and 254H are directly connected to a respective full bathroom 257H and 259H. The "J" unit includes one bedroom 253J on the same level as the living space 252J and a second bedroom 254J disposed one-half story above the living space 252J, which is accessible via the stairway 258J.

FIG. 10 also shows private stairway 256I, which runs through the second story 250 but does not provide access to second story 250 because it is a private stairway 256I providing the I unit direct access to stairway 156I, which in turn provides direct access to the garage space 152I.

The H dwelling unit (and the J dwelling unit) of second story 250 is a through-type unit and has a floor plan that extends from one side of the building to the other side of the building and includes widows looking outward to the view side 72 and the non-view side 74.

Referring to FIG. 8 together with FIG. 11, which is a floor plan of the third story 350. Naturally, the third story 350 is disposed directly above second story 250. Again, the elevator 80 bypasses the third story 350, and thus there is no access from the elevator 80 to the dwelling area on the third story 350. According to certain embodiments, a landing 90 of the fire stairway 82 is disposed on the third story 350. However, an alternate embodiment may omit the landing 90.

As previously described, private stairway 256I runs from one-half story above second ground level 70 directly to dwelling unit I. As such, dwelling unit I has direct access to garage 152I. Similar to the second story 250, the third story 350 includes the I dwelling unit (and the K dwelling unit), which includes living area 352I that is disposed one-half story below bedroom areas 353I and 354I. A stairway 356I traverses one-half story and provides access between living spaces 352I and bedrooms 353I and 354I. A kitchen area 355I is disposed on the lower half-level along with living area 352I. Each of the bedrooms 353I and 354I are directly connected to a respective full bathroom 357I and 359I. The "K" unit includes one bedroom 353K on the same level as the living space 352K and a second bedroom 354K disposed one-half story above the living space 352K, which is accessible via the stairway 356K. Dwelling unit I is defined by a through-unit-type floor plan, and therefore includes a view of view side 72 of midrise building 60.

Referring back to FIG. 9, garage 152J is disposed adjacent garage 152H, and garage 152K is disposed adjacent garage 152I. As shown in FIGS. 9-11, a dwelling unit J is disposed on the second story 250 and has direct access to garage 152J. A dwelling unit K is disposed on the third story 350 and has direct access to the garage 152K. Both J and K dwelling units have through-unit type floor plans that are substantially similar to the floor plans of the H and I dwelling units.

Figure 12:
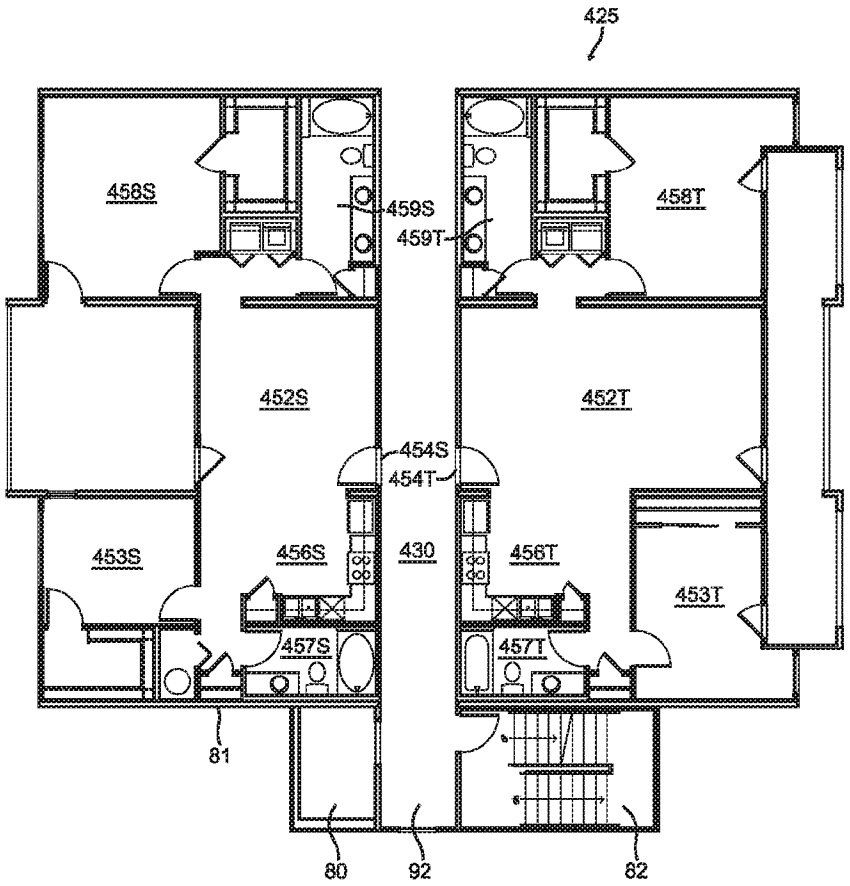
FIG. 12 is a plan view drawing of the fourth story of the mid-rise residential building illustrated in FIG. 8.

FIG. 12 illustrates floor plans of the dwelling units of the mid-section 63. Referring again to FIG. 8, the mid-section 63 is disposed directly above the lower section 62. The mid-section includes fourth story 425. The mid-section 63 is served by the elevator 80 and also the fire stairway 82. A landing 92 connects a corridor 430 to the elevator 80 and the fire stairway 82. In other embodiments, two elevators will serve the fourth stories 425 of a number of joined buildings 60 (see FIG. 17). Two elevators allow residents use of one elevator if the other is not operational because it is being serviced. The elevator(s) bypasses the lower section 62, and the lower section 62 is accessed by the stairways described above. As such, the lower section 62 is not covered by the Guidelines and is not accessible or compliant with the Americans with Disabilities Act. The mid-section 63 and the upper section 64, however, are covered by the Guidelines, as described in more detail below.

Referring to FIG. 12, which shows a floor plan of the fourth story 425. The fourth story 425 includes the corridor 430, and dwelling units S and T. Dwelling units S and T are fully wheelchair accessible, in part, because they are entirely on the fourth story 425 with elevation changes, if any, which do not require stairs. Dwelling units S and T may have the same floor plan, so this disclosure will only provide detail for dwelling unit S with the understanding that the reference numbers for dwelling unit T are the same as those described for dwelling unit S.

Living area 452S is accessed through doorway 454S that allows access from the corridor 430. A kitchen 456S is disposed adjacent living area 452S. A bedroom 458S is disposed adjacent and separated by a doorway from living area 452S. A second bedroom 453S is disposed on the other side of the living area 452S. Bedroom 458S is served by a bathroom 459S and closet space, and bedroom 453S is served by a closet space and a bathroom 457S. The doorways of dwelling unit S are large enough to accommodate a wheelchair, according to the Guidelines. Dwelling units S and T are not through unit-type floor plans in that they do not extend from view-side 72 and to non-view side 74.

Figure 13:
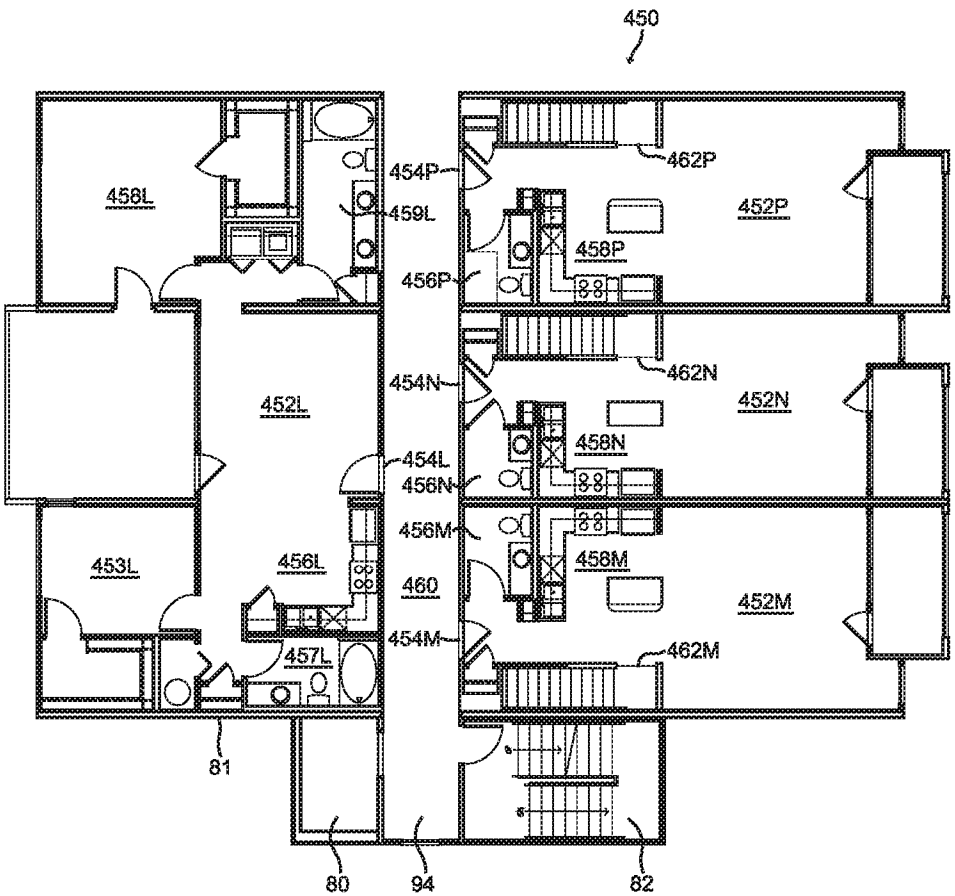
FIG. 13 is a plan view drawing of the fifth story of the mid-rise residential building illustrated in FIG. 8.
Figure 14:
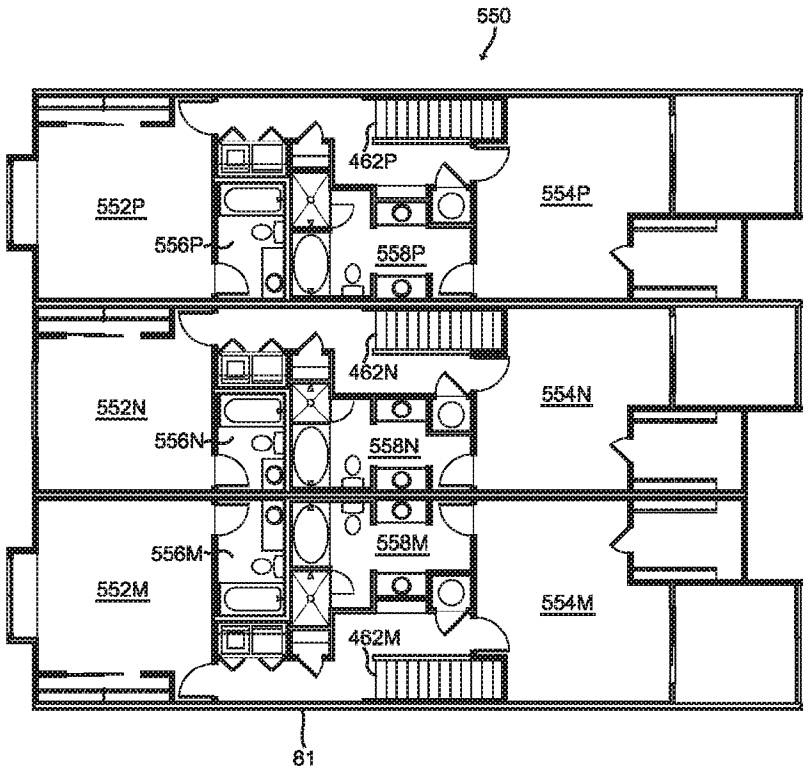
FIG. 14 is a plan view drawings of the sixth story of the mid-rise residential building illustrated in FIG. 8.

FIGS. 13 and 14 illustrate floor plans of the dwelling units of the upper section 64. Referring again to FIG. 8, the upper section 64 is disposed directly above the mid-section 63. The upper section includes fifth story 450 and sixth story 550. The upper section 64 is served by the elevator 80. As such, a landing 94 connects a corridor 460 with the elevator 80 and the fire stairway 82. In some embodiments, the upper section is served by two elevators.

According to an alternate embodiment, the building 60 may not include a mid-section, and the upper section 64 is disposed directly above the lower section 62 and is served by the elevator 80, which bypasses the lower section 62.

Referring to FIG. 13, which shows a floor plan of the fifth story 450. The fifth story 450 includes the corridor 460, and dwelling unit L, and the first floor of three multi-level dwelling units M, N, and P. Dwelling unit L is fully wheelchair accessible, in part, because it is entirely on the fourth story 450 with elevation changes, if any, which do not require stairs. Living area 452L is accessed through doorway 454L that allows access from the corridor 460. A kitchen 456L is disposed adjacent living area 452L. A bedroom 458L is disposed adjacent and separated by a doorway from living area 452L. A second bedroom 453L is disposed on the other side of the living area 452L. Bedroom 458L is served by a bathroom 459L and closet space, and bedroom 453L is served by a closet space and a bathroom 457L. The doorways of dwelling unit L are large enough to accommodate a wheelchair, according to the Guidelines. Dwelling unit L is not a through unit-type floor plan in that it does not extend from view-side 72 and to non-view side 74. However, because dwelling units M, N, and P are defined by a through unit floor plan at their respective upper levels, dwelling unit L may be disposed to have a window and a balcony on view side 72. In an alternate embodiment, dwelling units M, N, and P may have windows or a balcony on view side 72 on both its upper and lower levels.

According to an alternate embodiment, dwelling unit L may be a two-story dwelling unit. In this embodiment, at least a portion of the second stories of each of dwelling units L, M, N, and P are disposed above the first story of the respective dwelling unit. The second stories of each of dwelling units L, M, N, and P are accessed by a private stairway within the respective unit. Also, one of dwelling units M, N, and P may be a single story dwelling unit, and at least a portion of the second floor of one or more of the other two dwelling units is disposed over that single story dwelling unit.

Dwelling unit M is disposed across the corridor 460 from dwelling unit L and is accessed from the corridor 460 through doorway 454M. Proximate doorway 454M is disposed a powder room 456M. The powder room 456M includes a toilet and a sink. It does not necessarily include a shower. The doorway to the powder room 456M may be wide enough to accommodate a wheelchair, according to the Guidelines. Having a powder room accessible from the first level of dwelling unit M may be a requirement for dwelling unit M to be covered by the Guidelines. Living area 452M is disposed proximate a kitchen 458M. A stairway 462M runs a full story to a second level of dwelling unit M. In the illustrated embodiment, stairway 462M runs from fourth story 450 to fifth story 550. In other embodiments, a stairway similar to stairway 462M may run from a sixth story to a seventh story.

Disposed directly above fifth story 450 is sixth story 550. In one embodiment, neither the elevator 80 nor the fire stairway 82 ascends to the sixth story 550. Referring to FIG. 8, the sixth story 550 includes the second levels of dwelling units M, N, and P. For example, bedrooms 552M and 554M are located on fifth story 550 and are accessible via the stairway 462M. Bedrooms 552M and 554M may only be accessed by the stairway 462M. There is no corridor on the fifth story 550, and there is no public entrance on the fifth story 550. It should be noted that the bedrooms 552M and 554M on the second level of the M dwelling unit traverse over the corridor 460 and together bedrooms 552M and 554M define a through-unit type floor plan. A bathroom 556M is disposed adjacent bedroom 552M, and a bathroom 558M is disposed adjacent bedroom 554M. Each of the bathrooms 556M and 558M are full baths that include a shower or a bathtub in addition to a toilet and a vanity sink.

Disposed adjacent to dwelling unit M on both the fourth story 450 and the fifth story 550 is dwelling unit N, and disposed adjacent to unit N on fourth story 450 and fifth story 550 is dwelling unit P. Each of dwelling units N and P include the same features as dwelling unit M including a through-unit type floor plan and respective stairways 462N and 462P, which each provide a passageway from the first level to the second level. Dwelling units N and P also include a preferred view of view side 72 of the midrise residential building 60 at least on its upper level that has a through-unit-type floor plan.

Figure 15:
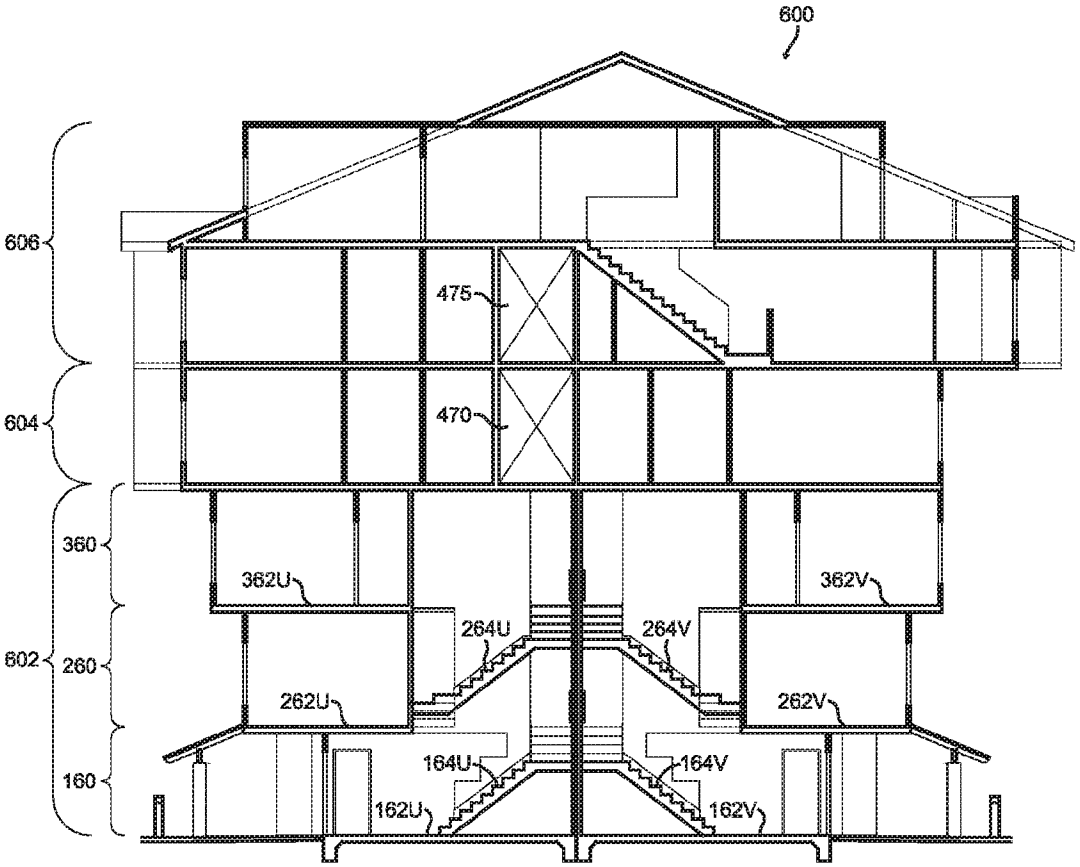
FIG. 15 is a cross-section view of another alternate embodiment of a mid-rise residential building according to the teachings of the present disclosure.

FIG. 15 illustrates an alternate embodiment of a residential building with an upper section served by an elevator that bypasses a lower section. The building 600 includes a lower section 602 with a midsection 604 immediately above the lower section. An upper section 606 is located immediately above the midsection.

The lower section 602 is similar to the lower sections 12 and 62 in that it includes first story 160, second story 260, and third story 360. The lower section 602 includes a plurality of back-to-back townhouse-type dwelling units. Two of the townhouse-type dwelling units are shown in FIG. 15, and two other identical townhouse units are disposed adjacent the illustrated townhouse units, such that the footprint of the building 600 is similar to buildings 10 and 60 described above. As the non-illustrated townhouse-type dwelling units are identical to the illustrated townhouse units, this disclosure will discuss only the two townhouse dwelling units illustrated in FIG. 15.

A pair of back-to-back private garages 162U and 162V is on the first story at grade level. In building 600, the levels of the entrances to and the private garages 162U, 162V are even, which is unlike the lower sections 12, 62 of the buildings 10, 60 shown and described with respect to FIGS. 1 and 8, which are offset by one-half story. The private garages 162U, 162V each include a vehicle entrance on opposite sides of the building 600. A stairway 164U and 164V provide private access from the garages 162U, 162V to living areas of respective dwelling units 262U and 262V. The living area 262U is disposed directly above the garage 162U, and the living area 262V is disposed directly above garage 162V. Directly above living area 262U is an upper dwelling unit level 362U, which is accessible by stairway 264U. Dwelling unit level 362V is directly above living area 262V and is accessible by a stairway 264V. The stairways 264U, 264V are private because they are in dwelling units U and V respectively. The upper level 362U may include one or more bedrooms or other living spaces. As illustrated, the townhouse-type dwelling units U and V are not through-unit dwelling units, but rather are in a back-to-back configuration.

The lower section 602 is accessible from grade through a private entrance and the private stairways 164U and 164V. Although an elevator serves the building 600, it bypasses the dwelling units of the lower section 602 and serves the dwelling units of the midsection 604 and the upper section 606. In this manner, the dwelling units of the lower section 602 are not wheelchair accessible and the lower section 602 is not covered by the Guidelines. In contrast, the midsection 604 and the upper section 606 include wheelchair accessible dwelling units, and the upper section is covered by the Guidelines. The midsection 604 and the upper section 606 include the floor plans and features illustrated and described above with respect to FIG. 5-7 or 12-14, depending on the footprint size of the building 600. For example, an elevator serves corridor 470 of the midsection 604 and corridor 475 of the upper section 606. According to yet another alternate embodiment, the building 600 may not include one but not the other of midsection 604 and upper section 606.

Figure 16:
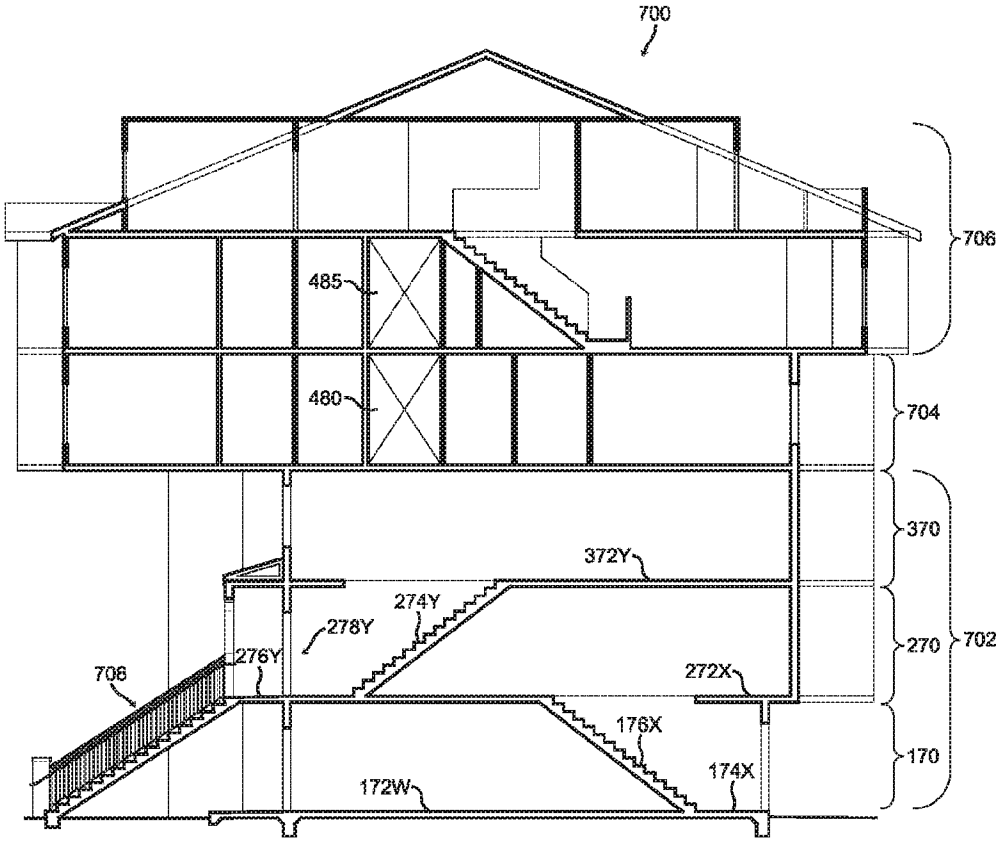
FIG. 16 is a cross-section view of yet another alternate embodiment of a mid-rise residential building according to the teachings of the present disclosure.

FIG. 16 is a cross section of yet another embodiment of a mid and upper section elevator served multistory residential building 700 where the elevator bypasses a lower section, which is served by stairways with the exception of dwelling unit 172W, which is a single story dwelling unit with an entrance at grade level. The building 700 includes a lower section 702 that includes a first story 170, a second story 270, and a third story 370. A midsection 704 is located directly above the lower section 702, and an upper section 706 that includes stories five and six is located directly above the midsection 704. According to an alternate embodiment, one of the midsection 704 and the upper section 706 is omitted from building 700.

In one embodiment, the lower section 702 includes the private stairways, a monumental stair, and through-unit dwelling units as set forth in U.S. Pat. No. 8,474,203, entitled "Multistory Residential Building with Private Stairway Accessible Units," issued on Jul. 2, 2013, which is hereby incorporated by reference.

Referring back to FIG. 16, the multistory residential building 700 includes a private garage 174X. A private stairway 176X is used to access the living area of dwelling unit 272X. Dwelling unit 272X is a through-unit in that it includes living space with windows on each side of the building 700 such that the dwelling unit extends through the building 700. The dwelling unit 272X is a single story dwelling unit and may include one or two bedrooms, one or two bathrooms, a kitchen, and other amenities.

The 372Y dwelling unit is located directly above the dwelling unit 272X. A monumental stairway 708 leads from grade to a landing 276Y. The landing provides access to an entranceway 278Y that leads to private stairway 274Y. The private stairway 274Y is part of dwelling unit Y and may be air conditioned. As air conditioned private living space, the square footage of the stairway room may be included in the overall square footage of dwelling unit 372Y and rent for the dwelling unit 372Y may be set accordingly with the increased square footage of private air conditioned living space. Similar to the dwelling unit 272X below, the dwelling unit 372Y is a single level dwelling unit with a through-unit floor plan. The dwelling unit 372Y includes one or two bedrooms, one or two bathrooms, a kitchen, and like amenities.

The lower section 702 is accessible from grade through the monumental stairway 708 leading to the private entrance 278Y and the private stairway 176X. Although an elevator serves the building 700, it bypasses the dwelling units of the lower section 702 and serves the dwelling units of the midsection 704 and the upper section 706. In this manner, the dwelling units of the lower section 702 are not wheelchair accessible and the lower section 702 is not covered by the Guidelines. In contrast, the midsection 704 and the upper section 706 include wheelchair accessible dwelling units, and the upper section is covered by the Guidelines. The midsection 704 and the upper section 706 include the floor plans and features illustrated and described above with respect to FIG. 5-7 or 12-14, depending on the footprint size of the building 700. For example, an elevator serves corridor 480 of the midsection 704 and corridor 485 of the upper section 706.

Figure 17:
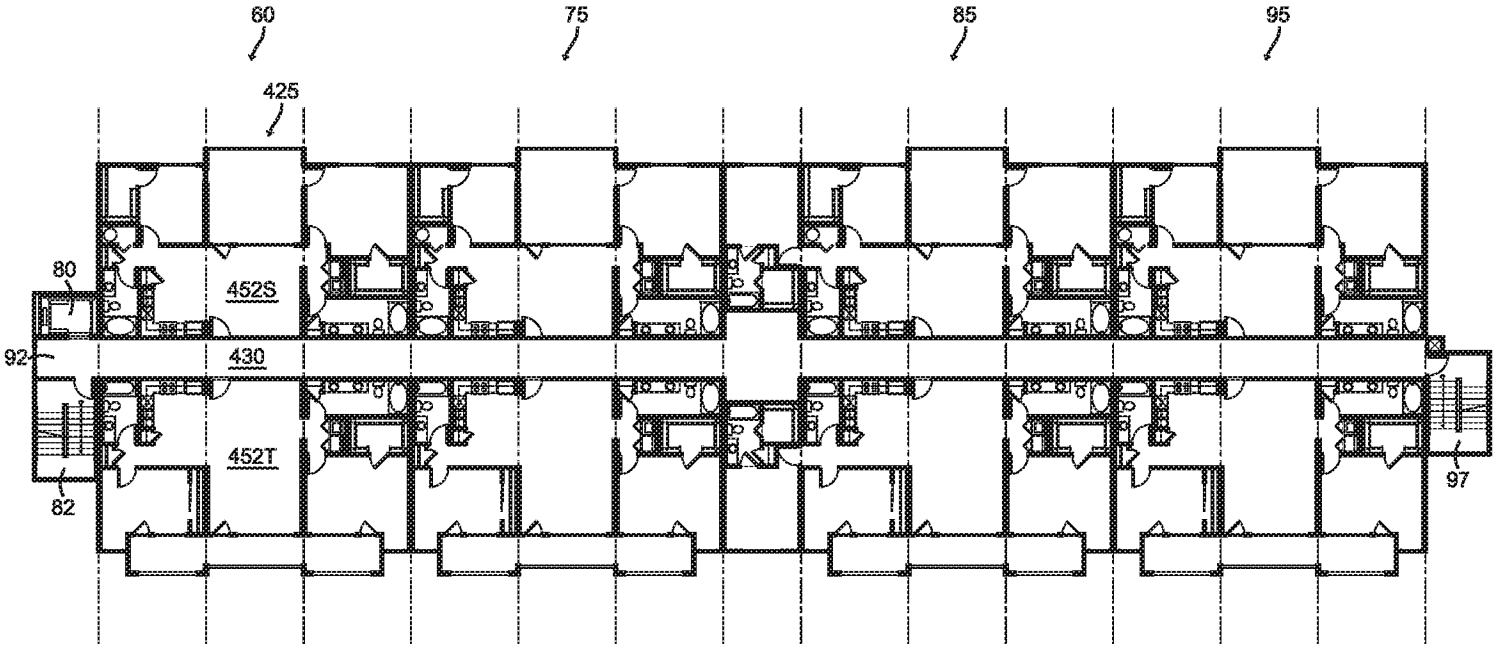
FIG. 17 is a plan view of a fourth story of four adjoining mid-rise residential buildings according to the teachings of the present disclosure.

FIG. 17 is a floor plan of a fourth story 425 of the mid-rise residential building 60 to illustrate a plurality of upper section elevator-served corridor buildings that may form part of an apartment complex according to the teachings of the present disclosure. The floor plan of the fourth story 425 is shown to illustrate the access provided by the elevator 80 and the fire stairway 82 through the landing 92 to the corridor 430. In this embodiment, the corridor 430 extends through the building 60, as illustrated in FIG. 12, and it also extends through adjoining building 75, adjoining building 85, and adjoining building 95. In this manner, the elevator 80 provides elevator access to the fourth stories of each of four mid-rise residential buildings according to the teachings of the present disclosure. Similarly, the elevator 80 provides access to the fifth stories (and thus the upper section 64) of the buildings 60, 75, 85, and 95. The lower sections 62 of buildings 60, 75, 85, and 95 are accessed via the stairways described with respect to first story 150, second story 250, and third story 350. A second fire stairway 97, and optionally a second elevator, is disposed at the opposite end of the buildings 60, 75, 85, and 95 to provide an additional emergency egress for the residents of the mid-sections and the upper sections.

According to an alternate embodiment, one or more of the buildings 10, 60, 600, and 700 includes an underground common garage disposed below the grade level of the respective building. In certain embodiments, multiple floors of common garage space provide additional parking spaces for residents of the midrise residential buildings 10, 60, 600, and 700. In such embodiments, an elevator that serves the midsections 13, 63, 604, and 704 and the upper sections 14, 64, 606, 706 and bypass the lower sections 12, 62, 602, and 604, such as elevators 40 and 80 also descend to the one or more levels of the common underground parking area to provide convenient access for residents of the midsections 13, 63, 604, and 704 and the upper sections 14, 64, 606, 706 to their vehicles. The elevators 40 and 80 may stop at grade level and still be considered to bypass the lower sections 12, 62, 602, and 604 because only private garages are located at the grade level, and the residents of the lower sections 12, 62, 602, and 604 must traverse stairways to access their living areas. In addition to the elevator access to from the midsections 13, 63, 604, and 704 and the upper sections 14, 64, 606, 706 to the underground garage, fire stairways 42, 82 also descend to provide access for residents of the midsections 13, 63, 604, and 704 and the upper sections 14, 64, 606, 706 to their vehicles parked in the common basement garage.

In lieu of or in addition to the underground basement common parking structure, a sheltered parking structure separate from the multi-story buildings 10, 60, 600, and 700 may be located on either one or both streets running on the sides of the multi-story buildings 10, 60, 600, and 700.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right" and "front" and "rear" and the like are used as words of convenience to provide reference points and are not to be construed as limiting terms.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, the present invention has been described in connection with what are presently considered to be the most practical and preferred embodiments, but it is to be understood that the invention is not to be limited to the disclosed embodiments. On the contrary, the invention is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A multistory residential building, comprising:

a lower section and an upper section, each section comprising multiple stories and multiple living units, the upper section including a corridor traversing the building, the lower section not including a corridor traversing the building;

the lower section comprising:

at least a pair of lower stacked living units and at least a pair of upper stacked living units, each unit having a through-unit floor plan extending through the building in a first direction;

a first pair and a second pair of garage areas respectively associated with said pairs of lower and upper living units, said first pair and a second pair garage areas disposed in end-to-end relationship, with the vehicular access openings to said first pair of garage areas being disposed opposite the vehicular access openings to the second pair of garage areas;

a first passageway interconnecting an entranceway to one of said pair of lower living units with one of said first pair of garage areas, a second passageway interconnecting an entranceway to one of said pair of upper living units with one of said second pair of garage areas, said first and second passageways being isolated from one another; and the grade level of said pair of second garage areas being higher than the grade level of said pair of first garage areas;

the upper section comprising:

the corridor served by an elevator and providing primary access to a plurality of living units;

one of the plurality of living units in the upper section having an entranceway and being a single story living unit; and at least two multi-story living units having respective entranceways disposed laterally across the corridor from the single story entranceway and each having a second floor with portions directly above the corridor and the single story living unit.

2. The multistory residential building of claim 1, wherein the plurality of living units of the upper section comprises at least three multi-story living units having respective entranceways disposed laterally across the corridor from the single story entranceway and each having a second floor with portion directly above the corridor and the single story living unit.

3. The multistory residential building of claim 1 wherein the elevator is supported by an exterior wall of the building.

4. The multistory residential building of claim 1 further comprising a single story mid-section disposed between the upper section and the lower section and having a corridor served by the elevator, the mid-section having a plurality of single story living units.

5. The multistory residential building of claim 4 wherein the single story living units of the mid-section comply with the apartment regulations of the Americans with Disabilities Act.

6. The multistory residential building of claim 1 wherein the single story living unit of the upper section complies with the apartment regulations of the Americans with Disabilities Act.

7. The multistory residential building of claim 1 wherein the second floor of the multi-story living units of the upper section each have a through-unit type floor plan.

8. The multistory residential building of claim 1 wherein a vertical distance between the grade level of said pair of first garage areas and said entranceways to said pair of lower living units is no more than one story; and the vertical distance between the grade level of said pair of second garage areas and said entranceways to said pair of upper living units is not more than one and one-half stories.

9. A residential building, comprising:

a lower section and an upper section disposed above the lower section, the upper section including a corridor traversing the building, the lower section not including a corridor traversing the building;

the lower section comprising:

a garage level comprising a plurality of private garages;

at least one pair of multistory dwelling units, each having a through unit floor plan and each providing direct access to a respective one of the private garages;

the upper section comprising:

the corridor traversing the building;

a first dwelling unit accessible primarily from the corridor; and at least two multistory dwelling units having respective entranceways disposed laterally across the corridor from the first dwelling unit, each multistory dwelling unit having a second floor with portions directly above the corridor; and an elevator serving the corridor of the upper section and bypassing the lower section.

10. The residential building of claim 9 wherein:

the lower section is not covered by design and construction requirements of the Fair Housing Act; and the upper section is covered by design and construction requirements of the Fair Housing Act.

11. The residential building of claim 9 wherein the upper section comprises three multistory dwelling units having respective entranceways disposed laterally across the corridor from an entranceway of the first dwelling unit and each having a second floor with portion directly above the corridor.

12. The residential building of claim 9 wherein the first dwelling unit is a single story dwelling unit.

13. The residential building of claim 9 wherein the first dwelling unit is a two-story dwelling unit.

14. The residential building of claim 9 further comprising a single story mid-section disposed between the upper section and the lower section and having a corridor served by the elevator, the mid-section having a plurality of single story living units.

15. A mid-rise residential building, comprising:

a lower section and an upper section disposed above the lower section, the upper section including a corridor traversing the building, the lower section not including a corridor traversing the building;

the lower section comprising:

a garage level comprising a plurality of private garages;

at least one pair of multistory dwelling units, each multistory dwelling unit providing direct access to a respective one of the private garages;

the upper section comprising:

the corridor traversing the building;

a first dwelling unit accessible primarily from the corridor; and at least two multistory dwelling units having respective entranceways disposed laterally across the corridor from the first dwelling unit and each having a second floor with portions directly above the corridor; and an elevator serving the corridor of the upper section and bypassing the lower section.

16. The mid-rise residential building of claim 15 wherein the first dwelling unit comprises two bedrooms.

17. The mid-rise residential building of claim 16 wherein each of the at least one pair of multistory dwelling units of the lower section comprises two bedrooms.

18. The mid-rise residential building of claim 17 wherein the elevator is supported by an exterior wall of the building.

19. The mid-rise residential building of claim 18 further comprising a single story mid-section disposed between the upper section and the lower section and having a corridor served by the elevator, the single story mid-section having a plurality of single story living units.

20. The mid-rise residential building of claim 15 wherein the at least one pair of multistory dwelling units are townhouse-type dwelling units disposed in a back-to-back configuration.

21. The mid-rise residential building of claim 15 wherein the at least one pair of multistory dwelling units are each accessed by a respective private stairway disposed one story above grade.

22. The mid-rise residential building of claim 15 wherein each of the at least one pair of multistory dwelling units have a through-unit floor plan.

* * * * *